United States Patent [19]

Gageur et al.

[11] 4,192,251

[45] Mar. 11, 1980

[54] DEVICE FOR TREATING A SHEET OF MATERIAL PARTIALLY ENCLOSING A BACKING ROLL OR A COOLING CYLINDER

[75] Inventors: Fritz Gageur, Lindau-Bodolz; Gerhard Trötscher, Lindau, both of Fed. Rep. of Germany

[73] Assignee: Lindauer Dornier Gesellschaft mbH, Fed. Rep. of Germany

[21] Appl. No.: 904,985

[22] Filed: May 11, 1978

[30] Foreign Application Priority Data

Jul. 23, 1977 [DE] Fed. Rep. of Germany ..... 2733335

[51] Int. Cl.[2] ..... B05C 3/12; B05C 11/06

[52] U.S. Cl. ..... 118/63; 118/69; 118/419

[58] Field of Search ..... 118/69, 419, 63; 354/317, 324, 328; 134/64 P, 122 P, 122 R; 266/112; 427/398 A, 398 B; 68/207, 183

[56] References Cited

U.S. PATENT DOCUMENTS

| | | | |
|---|---|---|---|
| 2,766,720 | 10/1956 | Müller et al. | 118/63 |
| 2,912,347 | 11/1959 | Yezek et al. | 118/69 X |
| 4,050,270 | 9/1977 | Vecchia | 68/158 |

FOREIGN PATENT DOCUMENTS

| | | |
|---|---|---|
| 1932905 | 1/1971 | Fed. Rep. of Germany . |
| 2359413 | 6/1975 | Fed. Rep. of Germany . |

*Primary Examiner*—John P. McIntosh
*Attorney, Agent, or Firm*—James E. Bryan

[57] ABSTRACT

This invention relates to an improvement in a device for treating a sheet of material, for example a sheet of foil and the like, which partially encloses a backing roll or a cooling cylinder, including slotted nozzles or wipers extending over the width of the sheet of material and positioned at intervals with respect to each other, for the application of a treating medium onto the sheet of material, the improvement comprising means whereby the backing roll or the cooling cylinder dips into a liquid in a segment-like manner, and means mounting the slotted nozzles or wipers below and above the liquid level and near the sheet of material on the segment surface of said backing roll or cooling cylinder.

4 Claims, 2 Drawing Figures

Figure 1:
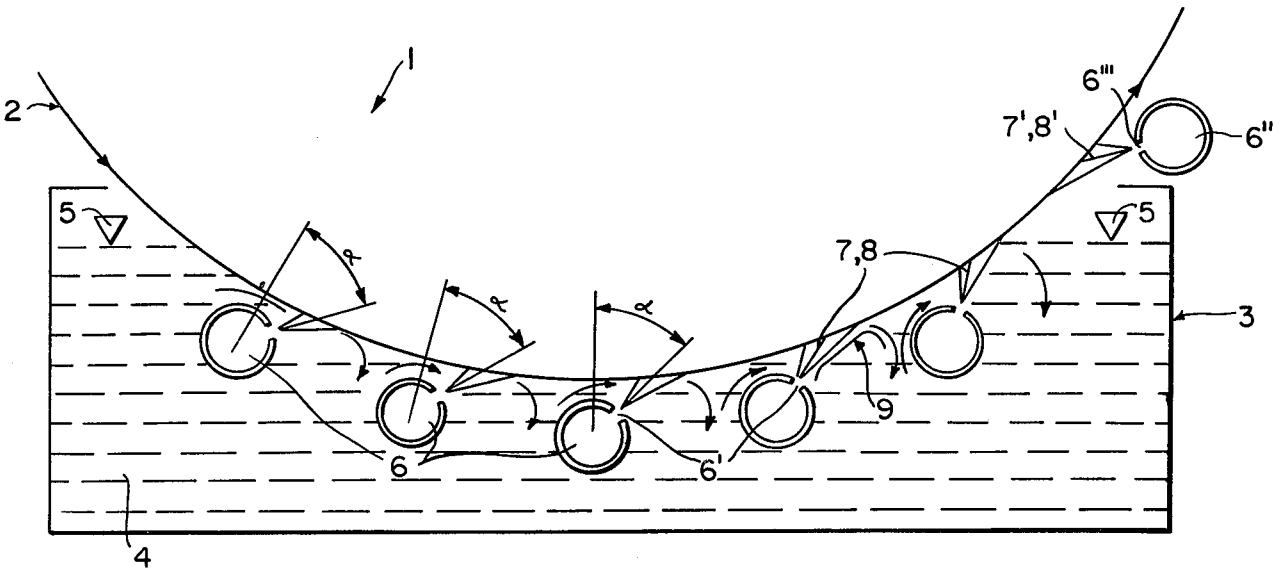

DEVICE FOR TREATING A SHEET OF MATERIAL PARTIALLY ENCLOSING A BACKING ROLL OR A COOLING CYLINDER

The present invention relates to a device for treating a sheet of material partially enclosing a backing roll or a cooling cylinder, for example a sheet of foil and the like, composed of slotted nozzles and/or wipers positioned at intervals with respect to each other over the width of the sheet of material for the application of a treating medium onto the sheet of material.

Such devices are employed, for example, in casting rolls and cooling cylinders where they serve for uniformly distributing a treating agent onto the surface of a sheet of material and, to the extent that they are used in the dipping process, are designated as underwater wipers.

Similar devices are known, for example, from German Auslegeschriften Nos. 1,932,905 (1) and 2,359,413 (2). Both refer to devices for coating a running sheet or web of material from paper, cardboard, synthetic material, and the like. In both of them, the coating mass is fed to a chamber or to an air jet or slotted nozzle extending over the width of the sheet of material which is positioned opposite the sheet of material being conveyed, and is open toward it.

In German Auslegeschrift (1), the chamber is delimited at the feed and at the delivery ends of the sheet of material by a rigid sealing and dosing blade which is tapered in the cross-section thereof with respect thereto. Both blades form a gap or a channel which is in connection with a supply channel and a feed pipe and rests against the sheet of material. The gap or channel is thereby directed against the sheet of material at an acute angle. In German Auslegeschrift (2), the tubular nozzle body is enclosed by clamping pieces which are positioned in pairs opposite each other and are displaceable about centers of rotation independently of each other. The discharge gap of the nozzle body is delimited by elongations diverging from the sheet of material. The width of the discharge gap is variable therein by displacement of the clamping pieces. A disadvantage in these known devices is the fixed oblique or perpendicular setting of the air jet or slotted nozzle with respect to the sheet of material. This means that it is not possible to cause a thin medium (for example water or gas) discharging from the air jet or slotted nozzle at a constant pressure to flow against the sheet of material at different impinging angles and distances. Also, a partial multiple arrangement of such devices about the backing roll is possible only at great structural expenditure.

It is a particular disadvantage in cooling cylinders which are internally cooled with water that a foil running thereon is cooled on one side only thereof. Backing rolls or cooling cylinders dipping into a liquid bath (full bath) likewise have not produced satisfactory results because, during the dipping or cooling of the hot foil, vapor bubbles are formed at its surface. This means that an uncontrolled heat transfer takes place at the surface of the foil, whereby surface variations are produced. Also, the air wipers known in the art for pressing the foil onto the cooling cylinder have not been found satisfactory with respect to the cooling effect achieved thereby. In the slotted nozzles or air jets used, in this case, supporting webs are necessary for attaining a uniform slot width over the nozzle width which webs have, however, an adverse effect during operation by reason of shadow formation.

It is therefore the object of the present invention to provide a device with which it is possible to spray or to impinge a sheet of material to be treated and resting upon a backing roll or a cooling cylinder with a treating medium which flows at constant pressure out of a pivotal slotted nozzle or air jet and which is preferably water or air. The slotted nozzle or air jet and the medium discharging therefrom should therein be pivotal within a specific angular range, displaceable as to the height thereof, and at the same time the exhaust or discharge and the onflowing pressure being required therefor should be regulatable. Furthermore, the structural expenditure should be small and should be so made that the device is adapted to be positioned in several places about the backing roll.

The advantage of the present invention resides particularly in that, due to the segment-like dipping of the backing roll or of the cooling cylinder into a liquid, and by virtue of the arrangement or provision of the slotted nozzles or wipers below the liquid level near the sheet of material resting upon the immersed segment surface of the backing roll, vapor bubble and shadow formation on the surface of the sheet of material is avoided with differently adjustable nozzle jet angles.

Futhermore, by virtue of the eccentric construction of a first external tubular jacket and the eccentric provision or arrangement of a thinner, constant thickness second tube within the first tube, as well as due to the arrangement being pivotal and displaceable about a joint axis, there is guaranteed a continuous and constant pressure distribution of the treating medium within the inflowing area of the slotted nozzle or air jet, and therewith also for its egress at the slotted nozzle. The variable pressure constancy being achieved as a result has the effect that the jet of the treating medium discharging from the slotted nozzle and being directed against the sheet of material remains constant in its intensity, independently of how large the jet length is that results from the pivoting range of the slotted nozzle.

Furthermore, due to the provision of displaceable baffle plates between the slotted nozzles or wipers, an injector effect occurs with which the liquid flow between the baffle plates and the sheet of material produces a controlled and variable heat transfer to the sheet of material. As a result, vapor bubble formation and an uncontrolled heat transfer are eliminated.

The treating medium, preferably water or air, flows first through the second, internal, thin-walled tube through an aperture (for example an elongated slot or bores) which is positioned opposite the slotted nozzle in the first external tube, and into the sickle-shaped space being formed by the outer wall of the internal tube and the internal wall of the first tube. At that time, the treating medium flows first into the wider part of this space in order to process from the aperture symmetrically toward both space halves, being tapered, and into the narrow inlet zone of the slotted nozzle (see arrows). The entry zone may be varied in its dimension by radial displacement of the internal second tube in the direction of the slotted nozzle. Accordingly, the supply of the treating medium is regulatable with respect to quantity and pressure, whereby—depending upon the pivoting angle of the first external tube and the slotted nozzle therein—the jet discharging therefrom is adjustable. The range of the pivoting angle of the first tube with the slotted nozzle therein is thereby equally between this angular area, and this guarantees that the jet directed onto the sheet of material—independently of its length—has the same intensity at all times and impinges upon the sheet of material to be treated with the same force.

The apertures within the second, internal tube are variably distributed in their dimensions over the length of the tube. This guarantees that the treating medium may flow out uniformly along the tube. In order to prevent that the slotted nozzle widens as a result of the pressure exerted upon its tubular walls, the slotted nozzle has a nearly even bending strength, with reference to its sickle-shaped cross-section. With this cross-sectional shape of the slotted nozzle or nozzle body, the heretofore employed but disadvantageous supporting webs are eliminated. Because the nozzle body corresponds to a curved rod having the same rigidity, the sickle-shaped cross-section compensates for differences in the bending moment. As a result thereof, the stress remains constant over the entire circumference. This means that, as a result, also pressure changes and therewith impinging variations at the slotted nozzles are precluded.

Figure 2:
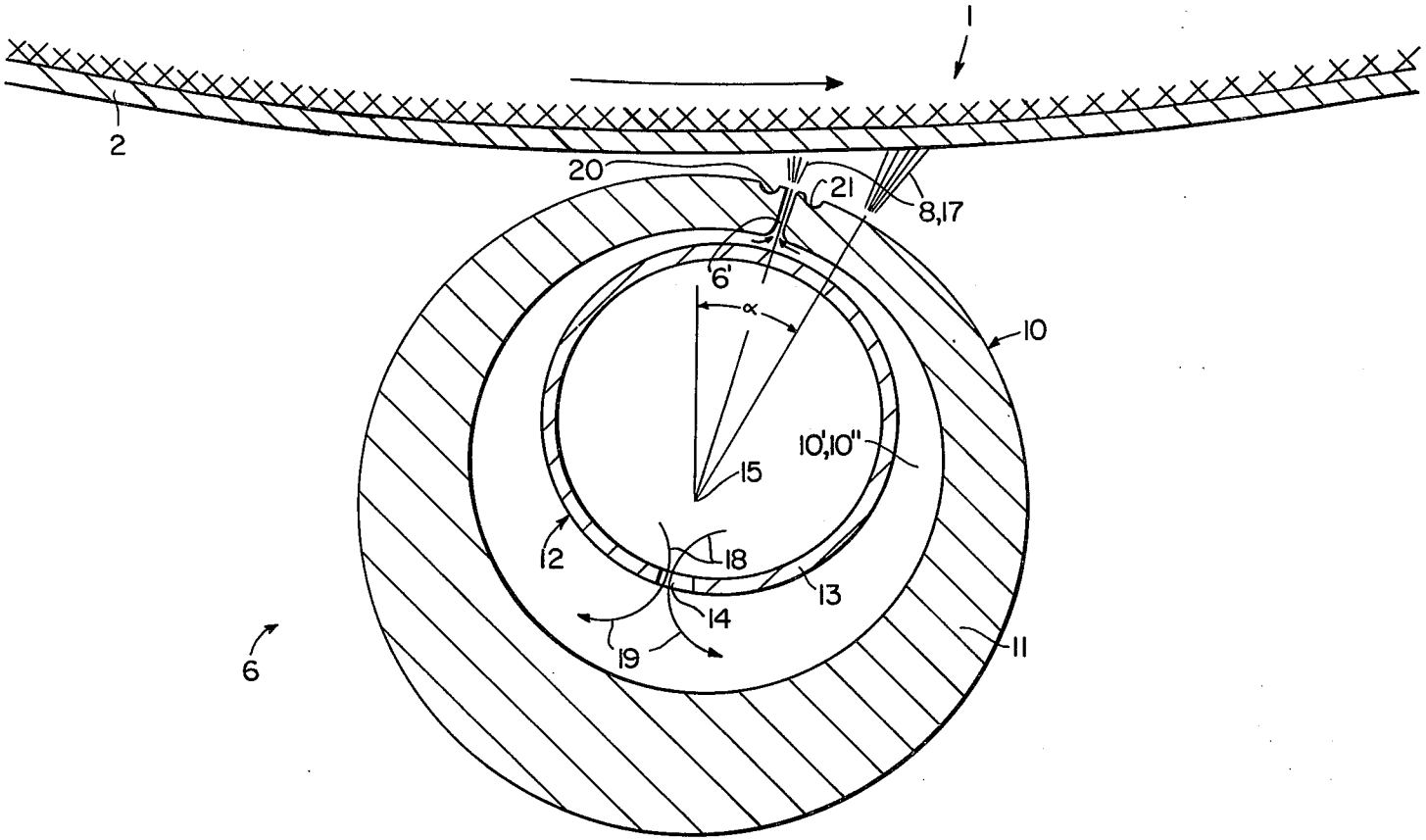

Embodiments according to the present invention will now be further described hereinafter and are illustrated in the accompanying drawings, wherein FIG. 1 illustrates a backing roll dipping segment-wise into a liquid, with a sheet of material resting thereon and with slotted nozzles positioned thereunder, and FIG. 2 illustrates the basic provision of a pivotal slotted nozzle directed against a sheet of material.

In FIG. 1, a backing roll 1 dips with a sheet of material 2 resting upon its peripheral area segment-wise into a liquid 4 (for example a water bath) present within a container 3. Positioned along the segment of the backing roll 1 immersed into the liquid 4 below the liquid surface or level 5 and near the sheet of material 2 resting thereon are slotted nozzles or wipers 6 separated from each other at intervals whose slotted nozzles 6' guide jets 7 of a treating medium 8 (for example cooled water) against the sheet of material 2 at varying pivoting or setting angles $\alpha$. Positioned between the slotted nozzles or wipers 6 arranged individually and in tandem with respect to each other are, if desired, baffle plates 9 (one of which is shown in the figure). Achieved with the aid thereof is a better onflow (see arrows) onto the surface of the sheet of material 2 with the treating medium 8, and the formation of air and vapor bubbles during the cooling of a, for instance, hot foil (injector effect) is avoided. For the purpose of removing the treating medium 8 adhering to the surface of the sheet of material 2 there are provided one or several slotted nozzles or wipers 6'' arranged in tandem from whose slotted nozzles 6''' jets 7' of a treating medium 8' (for example air) are directed against the transporting direction (see arrow).

Illustrated in FIG. 2 at the top is a sheet of material 2 (for example a sheet of foil or the like) being moved in the direction of the arrow and enclosing a backing roll 1 (shown only in a partial cutout), which sheet is sprayed from below with a treating medium 8 (for example water or air), which flows from a slotted nozzle or wiper 6 or 6' against the sheet of material 2. The slotted nozzle 6' is positioned within a tube 10 whose wall in cross-section 11 has a sickle-shaped configuration, and the nozzle position is at the narrowest and weakest point of the wall 11. Positioned within the tube interior 10' and situated eccentrically with respect to the sickle-shaped cross-section of the wall 11 and an eccentric channel 10'' formed thereby is a second constant thickness thinner tube 12 eccentrically positioned with respect thereto, which has in its wall 13 apertures 14 (for example slots or bores) opposite the slotted nozzle or wiper 6'. Both tubes 10 and 12 are positioned in a joint axis 15 and are jointly pivotal or tiltable with respect thereto. The pivoting angle range is through an angle $\alpha$. This means that the slotted nozzle or wiper 6' in the wall 11 of the tube 10 and the apertures 14 in the wall 13 of the internal second tube 12 are movable through this pivoting angle. As a result thereof the jet 17—issuing from the slotted nozzle or wiper 6'—of the treating medium 8 which flows out of the interior 18, 19 of the tubes 10 and 12 will flow against the sheet of material 2 either perpendicularly or at an angle $\alpha$. By means of the radial eccentric displacement of the internal second tube 12 the free cross-section or channel 10'' of the tube interior 10' is variable, whereby in the narrow entry area of the slotted nozzle 6' the quantity and the pressure, and therewith the egress or discharge of the treating medium 8 from the slotted nozzle 6', are regulatable. Cut in the wall 11 of the first tube 10 at the outlet of the slotted nozzle 6 and on both sides thereof are the notches 20, 21 for the purpose of preventing vorticities of the jet 17. The two tubes 10 and 12 are subjected to a relatively high pressure of up to a maximum of 8 atmospheres and are exposed to corrosion. They must therefore be made from a correspondingly suitable material (for example a corrosion-resistant alloy of AlZnMgCu 0.5 F 48).

It will be obvious to those skilled in the art that many modifications may be made within the scope of the present invention without departing from the spirit thereof, and the invention includes all such modifications.

What is claimed is:

1. In a device for treating a sheet of material, for example a sheet of foil and the like, which partially encloses a backing roller or a cooling cylinder, said device including a plurality of outer tubes each having a slot nozzle thereon, an inner tube in each of said outer tubes and having an aperture therein positioned opposite the slot nozzle of the outer tube, said outer tubes being positioned at intervals with respect to each other and above and below a liquid level, the improvement that said outer tubes have an eccentric interior, means supporting said inner tubes in an eccentrically pivotal manner, means whereby both of said tubes are jointly pivotal about a common axis, and means whereby the inner tubes are radially displaceable with respect to the outer tubes.

2. A device according to claim 1 in which the apertures are different in the dimensions thereof.

3. A device according to claim 1 in which the cross-section of the outer tubes have approximately the same bending strength.

4. A device according to claim 1 including adjustable baffle plate means between the slotted nozzles or wipers in the direction of the discharging treating medium.

* * * * *